US006752129B2

(12) United States Patent
Isozaki et al.

(10) Patent No.: US 6,752,129 B2
(45) Date of Patent: Jun. 22, 2004

(54) FUEL SUPPLY MODULE MOUNTING STRUCTURE FOR FUEL TANK

(75) Inventors: Akihiro Isozaki, Kanagawa-ken (JP); Hiroki Isobe, Kanagawa-ken (JP)

(73) Assignee: Nissan Motor Co., Ltd., Kanagawa-ken (JP)

( * ) Notice: Subject to any disclaimer, the term of this patent is extended or adjusted under 35 U.S.C. 154(b) by 6 days.

(21) Appl. No.: 10/310,830

(22) Filed: Dec. 6, 2002

(65) Prior Publication Data

US 2003/0106537 A1 Jun. 12, 2003

(30) Foreign Application Priority Data

Dec. 6, 2001 (JP) ..... P2001-373149

(51) Int. Cl.[7] ..... F02M 37/04
(52) U.S. Cl. ..... 123/509; 417/363
(58) Field of Search ..... 123/509, 518, 123/519; 417/363, 360, 362

(56) References Cited

U.S. PATENT DOCUMENTS 4,569,637 A * 2/1986 Tuckey ..... 417/360
4,706,707 A * 11/1987 Betterton et al. ..... 137/565.24
4,869,225 A * 9/1989 Nagata et al. ..... 123/509
5,038,741 A * 8/1991 Tuckey ..... 123/509

FOREIGN PATENT DOCUMENTS

JP P2001-214825 A 8/2001

* cited by examiner

*Primary Examiner*—Mahmoud Gimie
(74) *Attorney, Agent, or Firm*—McDermott, Will & Emery

(57) ABSTRACT

A fuel supply module mounting structure for a fuel tank (1) is disclosed having a fuel tank module (6) comprised of a tilting mechanism (TM) disposed between an upper plate (5) and a case (8,30) and operative to cause the case to be tilted in a direction away from a valve (20) in response to vertically upward movement of the case in a value beyond a given amount of stroke upon abutting engagement of the case with a bottom wall portion (3) of the fuel tank, avoiding interference between the valve (20) and a pump (9) contained in the case (8,30).

8 Claims, 5 Drawing Sheets

FUEL SUPPLY MODULE MOUNTING STRUCTURE FOR FUEL TANK

BACKGROUND OF THE INVENTION

The present invention relates to a fuel supply module mounting structure for a fuel tank.

Attempts have heretofore been made to provide a fuel supply module, comprised of a case of an upper open-ended type in which a pump is contained, which is suspended from an upper plate mounted to a fuel tank having its upper end formed with an opening which is concealed with the upper plate, with the fuel supply module being supported with a bottom wall portion of the fuel tank (see Japanese Patent Provisional Publication No. 2001-214825 which discloses a similar related art). It is structured that a bottom wall of the fuel supply module is continuously held in abutting contact with the bottom wall portion of the fuel tank for vertical movements upon an aid of an own weight of the fuel supply module and an urging member exerting the same downward for permitting fuel to be reliably drawn from an area near the bottom wall portion of the fuel tank. Factors under which the bottom wall portion of the fuel tank is vertically moved include variations in internal pressure of the fuel tank or interference between the bottom wall portion of the fuel tank and projections on a road surface.

Further, there are some instances where valves (such as a vent valve and a cut valve) for treating evaporated fuel are mounted to the upper plate from which the fuel supply module is suspended. These valves are mounted to the upper plate in such a way that they protrude downward from the upper plate into the fuel tank. Thus, the provision of the valves disposed in the fuel tank from an initial time enables the evaporated fuel to be treated in an efficient manner.

SUMMARY OF THE INVENTION

However, with the structure of such a related art, the evaporated fuel treatment valves are mounted to the upper plate, from which the fuel supply module is suspended for free movements in a vertically variable stroke, so as to downwardly protrude into the fuel tank, resulting in a risk of interference of the valves with the hard pump inside the fuel supply module when the fuel supply module is excessively raised by a value beyond a given amount of stroke. To this end, it is required for the related art structure to enhance a large amount of vertical space between the valves and the fuel supply module in order to avoid the interference between the valves and the fuel supply module, resulting in a difficulty in placing both the fuel supply module and the valves in the fuel tank with a small vertical dimension.

The present invention has been made with the above view in mind and has an object of the present invention to provide a fuel supply mounting structure which is able to locate both a fuel supply module and valves into a fuel tank even with a small vertical dimension.

According to a first aspect of the present invention, there is provided a fuel supply module mounting structure for a fuel tank having an upper plate supporting a downwardly extending valve to treat evaporated fuel, the fuel supply module mounting structure comprising: a fuel supply module having a case and a pump disposed therein to draw fuel from a fuel tank; and a tilting mechanism disposed between an upper plate of a fuel tank and the fuel supply module and including a guide member suspended from the upper plate and extending toward the fuel supply module and a follower member guided with the guide member to permit the fuel supply module to be normally moveable closer to and away from the upper plate in a freely variable stroke; wherein the guide member and the follower member of the tilting mechanism are operative to cause the fuel supply module to be tilted in a direction to be separated away from a downwardly extending valve in response to an external force exerted to the fuel supply module during an upward movement of a bottom wall portion of the fuel tank.

With such a structure set forth above, the tilting mechanism is normally operative to permit vertical movements of the fuel supply module within the fuel tank in dependence on upward movement of the bottom wall of the fuel tank. As the fuel supply module reaches the uppermost limit position, the tilting mechanism is further operative to permit the fuel supply module to be tilted in the direction away from the downwardly extending valve due to the external force exerted to the bottom end of the fuel supply module. Thus, the fuel supply module is enabled to be moveable within the fuel tank to assume a desired operative position to draw fuel therefrom at the highest performance without conflicting the downwardly extending valve. The fuel supply module mounting structure has a compact structure and is low in manufacturing cost.

According to a second aspect of the present invention, there is provided a fuel supply module mounting structure for a fuel tank having an upper plate supporting a downwardly extending valve to treat evaporated fuel, the fuel supply module mounting structure comprising: a fuel supply module having a case and a pump disposed therein to draw fuel from a fuel tank; and a tilting mechanism disposed between an upper plate of a fuel tank and the fuel supply module and including guide means suspended from the upper plate and extending toward the fuel supply module and follower means guided with the guide means to permit the fuel supply module to be normally moveable closer to and away from the upper plate in a freely variable stroke; wherein the guide means and the follower means are operative to cause the fuel supply module to be tilted in a direction to be separated away from a downwardly extending valve in response to an external force exerted to the fuel supply module during an upward movement of a bottom wall portion of the fuel tank.

DETAILED DESCRIPTION OF THE PREFERRED EMBODIMENTS

Figure 1:
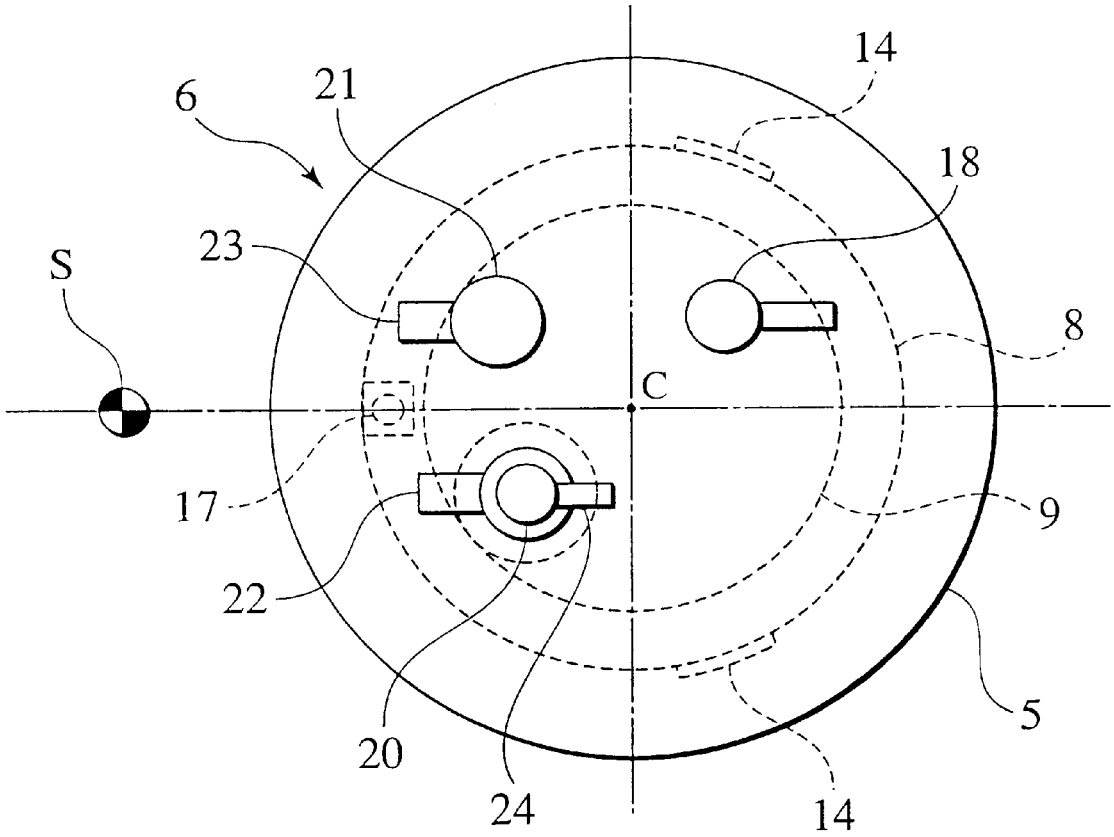
FIG. 1 is a plan view of a fuel supply module mounting structure illustrating a first embodiment according to the present invention.

Referring to the drawings, a fuel supply module mounting structure, for use in a fuel tank, of a preferred embodiment according to the present invention is described below in detail.

Figure 2:
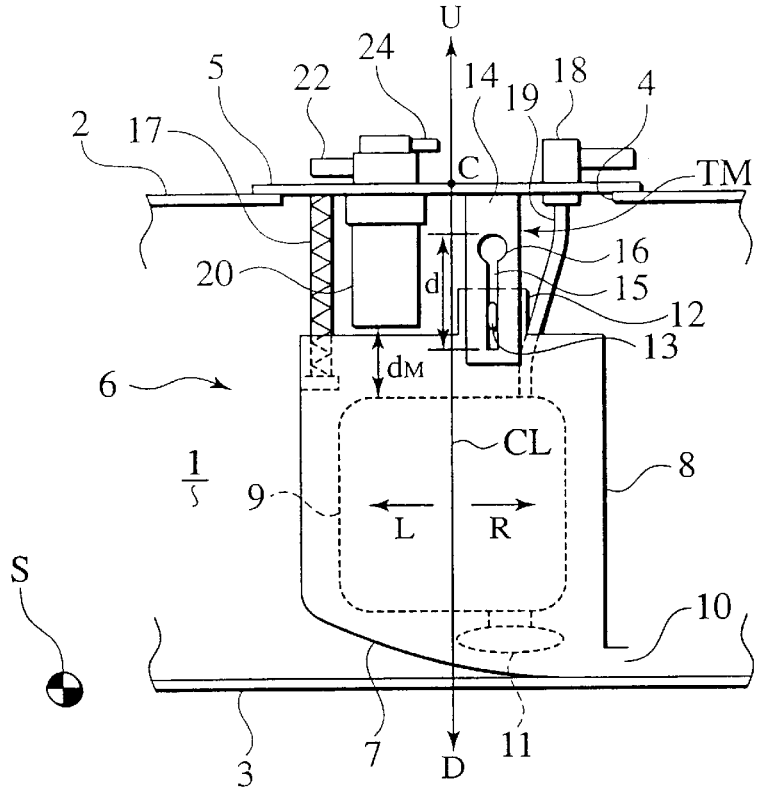
FIG. 2 is a side view illustrating the fuel supply module mounting structure shown in FIG. 1.
Figure 3:
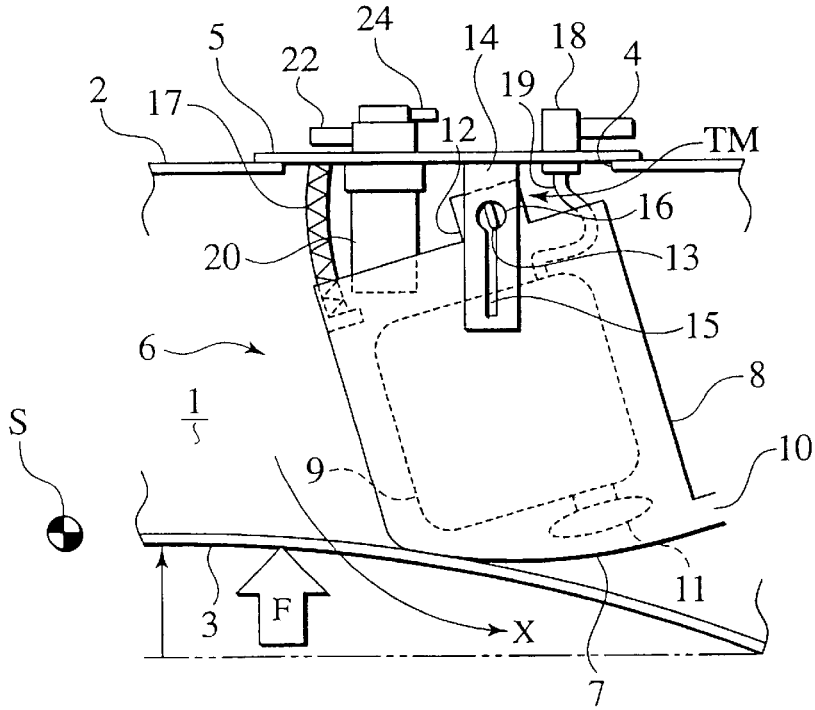
FIG. 3 is a side view illustrating the fuel supply module mounting structure, shown in FIG. 2, in its inclined condition.
Figure 4:
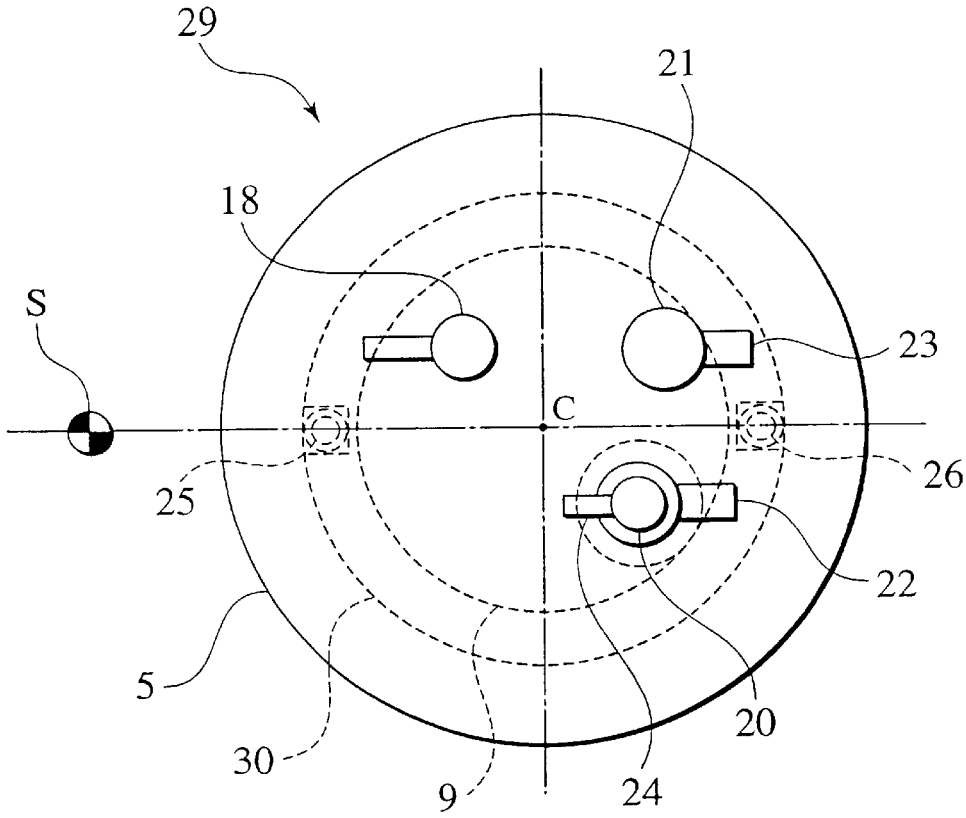
FIG. 4 is a plan view of a fuel supply module mounting structure illustrating a second embodiment according to the present invention.
Figure 5:
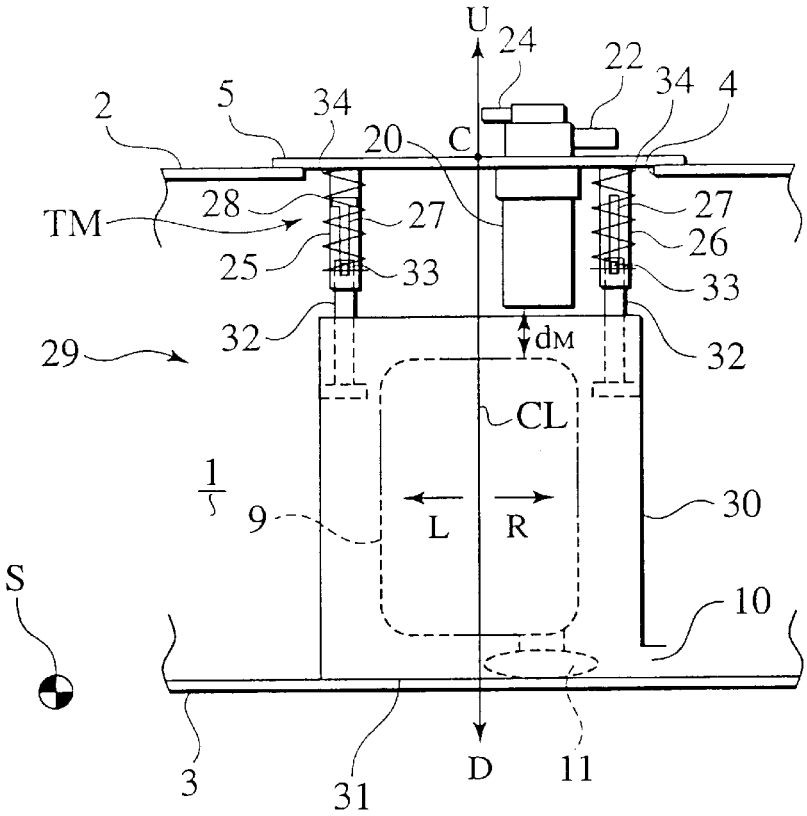
FIG. 5 is a side view illustrating the fuel supply module mounting structure shown in FIG. 4.

FIGS. 1 to 3 show a fuel supply module mounting structure of a first embodiment according to the present invention. A fuel tank 1 entirely has a hollow vessel shape and is formed of a top wall portion 2 and a bottom wall portion 3 located at upper and lower areas, respectively. A position of the bottom wall portion 3 moves upward or downward due to variations in internal pressure of the fuel tank 1 or due to conflict with irregular protrusions on road surfaces during traveling of a vehicle. Further, a deformation center S of the bottom wall portion 3 designates a point at which the amount of deformation takes the greatest value when the internal pressure in the fuel tank 1 is reduced and the bottom wall portion 3 is naturally raised.

The top wall portion 2 is formed with a circular opening 4, to which a circular upper plate 5 is mounted from an upper side to close the opening 4.

Suspended via a tilting mechanism TM from a rear surface of the upper plate 5 is the fuel supply module 6 with its lower end supported with the bottom wall portion 3. The fuel supply module 6 includes an upper open-end type case 8 formed in a cylindrical shape and having a peripheral wall whose one bottom end, closer to the deformation center S, is located at a high level and the other bottom end, remaining at an opposite side, terminating at the lowest level with a curvedly inclined bottom wall 7 extending between the one bottom end and the other bottom end, and a pump 9 contained in the case 8. Here, let it be considered that the deformation center S designates a left side of a center line CL shown in FIG. 2 and the opposite side designates a right side of the center line CL. In the following description of the fuel supply module 6 described herein, directional terms, such as "right side" and "left side" of the center line CL, are used to mean "deformation center S side" and "opposite side", respectively, for convenience in referring to the accompanying drawings. Formed at the right side of the case 8 is a fuel intake port 10 through which fuel is drawn, with a filter 11 of the pump 9 being located in an area near the fuel intake port 10 to draw fuel to the fuel pump 9.

The tilting mechanism TM is operatively disposed between the upper plate 5 of the fuel tank 1 and the fuel supply module 6 and includes a "guide member" and a "follower member" guided with the guide member.

The guide member is comprised of a pair of stays 14, 14, suspended from a rear surface of the upper plate 5 and extending toward the fuel supply module 6 at positions (offset positions) displaced rightward from the center line CL. An inner side wall of each stay 14 has a surface, curved in the lateral direction, to mate with an outer surface of each protruding segment 12 and is formed with a vertically extending guide slit 15 with a width slightly larger than that of an associated boss portion 13 described below. Further, formed in each stay 14 at the uppermost limit position of the guide slit 15 is a circular guide bore 16 to be contiguous with the guide slit 15 with a diameter slightly larger than the vertical length of the boss portion 13.

The follower member is comprised of a pair of protruding segments 12 extending upward from an upper end periphery of the case 8 and a pair of boss portions 13 laterally extending from the protruding segments 12, respectively, which mate with and are guided with the guide member to permit the fuel supply module 6 to be normally moveable closer to and away from the upper plate 5 in a freely variable stroke. The boss portion 13 has an oblong shape in cross section with a longitudinal axis thereof extending in a vertical direction to be movable within the associated slit 15.

With the uppermost limit position of the fuel supply module 6, the boss portions 13 of the follower member are brought into engagement with the guide bores 16 of the guide member to permit the guide member and the follower member of the tilting mechanism TM to be operative to cause the fuel supply module 6 to be tilted in a direction to be separated away from a downwardly extending valve, composed of a vent valve 20, in response to an external force F exerted to the bottom wall 7 of the fuel supply module 6 during an upward movement of the bottom wall portion 3 of the fuel tank 1.

During normal vertical movements of the fuel supply module 6, i.e., during upward or downward movements of the fuel supply module 6 within a stroke below the uppermost limit position, the boss portions 13, serving as the follower member, slide in the guide slits 15 of the pair of stays 14, serving as the guide member, to allow the fuel supply module 6 to be entirely and freely moveable in the vertical stroke. Thus, even when the bottom wall portion 3 of the fuel tank 1 vertically fluctuates due to an own weight of the fuel supply module 6, the bottom wall 7 of the fuel supply module 6 is held in abutting engagement with the bottom wall portion 3 at all times so as to follow the vertical movements thereof. This results in a capability for the pump 9 to effectively draw fuel from an area in the vicinity of the bottom wall portion 3 of the fuel tank 1.

A left portion of the upper end of the case 8 is suspended from the upper plate 5 via a spring 17 serving as an urging member at a position right side of the center line CL. That is, due to the provision of the stays 14 and the boss portions 13 located at the positions (offset positions) displaced at the right side of the center line CL, the own weight of the fuel supply module 6 causes the lower end of the fuel supply module 6 to rotate rightward with respect to the center line CL such that the boss portions 13 are inclined within the guide slits 15 and locked therein and a difficulty is encountered in achieving normal further vertical movement of the fuel supply module 6. But, the presence of the spring 17, with which the case 8 is suspended from the upper plate 5 at the left side of the center line CL by means of the spring 17, enables correction of a biased own weight (rotational) action (caused by the offset positions of the stays 14 and the boss portions 13 displaced from the center line CL) of the fuel supply module 6, providing a capability for the fuel supply module 6 to vertically move along the stays 14 in a reliable manner.

Provided on the upper plate 5 in an area displaced at the right side of the center line CL is a feed nozzle 18 which is connected to the pump 9 via a flexible tube 19 for supply fuel. Further, formed on the upper plate 5 in an area displaced at the left side of the center line CL are a vent valve 20 and a cut valve 21 serving as the downwardly extending valves. The vent valve 20 and the cut valve 21 have vapor nozzles 22, 23, respectively, which are formed at areas above the upper plate 5 to feed evaporated fuel resulting in the fuel tank 1 to an engine which is not shown. Also, disposed at a side of the vent valve 20 is a sensor nozzle 24 that is connected to a fuel charge port which is not shown. The vent valve 20 and the cut valve 21 internally contain valve mechanisms that are open and closed, respectively, in dependence on the internal pressure of the fuel tank 1, resulting in capabilities for the vent valve 20 to be opened during refueling to allow evaporated fuel to be fed to the engine while permitting the cut valve 21 to be opened at a time instant subsequent to termination of refueling at a higher internal pressure than that attained during the refueling operation to allow the evaporated fuel to be fed to the engine.

While the presence of the case 8 of the fuel supply module 6 being configured in the upper open-end structure avoids interference between a bottom end of the vent valve 20 and the case 8, if the fuel supply module 6 happens to move upward by a distance beyond a given amount of stroke, there is a provability of interference between the pump 9 inside the case 8 and the vent valve 20. Such interference specifically tends to occur in a case where the fuel tank 1 has a small vertical dimension with a resultant difficulty in adequately enhancing a vertical space between the vent valve 20 and the cut valve 21 and the pump 9.

With this embodiment, a "given amount $d_M$ of stroke" is determined to be an amount of stroke that allows the fuel supply module 6 to be raised while held in a vertical condition along the stays 14 immediately before the pump 9 conflicts with the vent valve 20, and the circular bores 16 contiguous with the slits 15 are formed at the uppermost limit positions within a range (a range in that the amount d of stroke satisfies a formula $d<d_M$) of the given amount of stroke to permit the boss portions 13 to assume "the uppermost engaging positions" at which the boss portions 13 are brought into engagement with the circular bores 16 to fall in rotational condition.

Now, the operation of this embodiment is described below in detail with reference to FIG. 3. This embodiment is shown in a condition where the bottom wall portion 3 of the fuel tank 1 is moved upward with the greatest amount of deformation encountered (similarly during reduction in the internal pressure of the fuel tank 1) in the area of the bottom wall portion 3 at the left side of the center line CL caused by the external force F exerted thereto due to conflict with the projection on the road surface.

As the bottom wall portion 3 is raised, in the range ($d<d_M$) of the given amount of stroke that causes the pump 9 to interfere with the bottom end of the vent valve 20, the boss portions 13 move along the slits 15 to allow the fuel supply module 6 to be raised while remained in the vertical attitude. Although the bottom wall 7 of the case 8 includes the curvedly inclined surface, since the fuel supply module 6 is suspended for free movements in the vertical stroke, the presence of the bottom wall portion 3 enabled to move in the vertical direction allows the fuel supply module 6 to be raised without any resistance.

And, as the boss portions 13 arrive at the circular bores 16 formed at the uppermost limit positions of the slits 15, a further upward movement of the fuel supply module 6 is avoided. Under such a condition, since the bottom wall 7 of the fuel supply module 6 has the curvedly inclined surface 7 with the lower cornering area at the left side of the center line CL being formed at the high level, if the bottom wall portion 3 of the fuel tank 1 is strongly brought into abutting engagement with the bottom wall 7 of the fuel supply module 6, the bottom wall 7 of the fuel supply module 6 is rotated in a direction (as shown by an arrow X) away from the valves about a center of the engaged region between the boss portion 13 and the circular bore 16, thereby causing the fuel supply module 6 to be entirely tilted in such a direction. For this reason, the interference between the vent valve 20 and the pump 9 inside the fuel supply module 6 is avoided, thereby enabling the vent valve 20 to be prevented from being damaged.

Further, even if the bottom wall portion 3 of the fuel tank 1 is strongly pushed up, the fuel supply module 6 is tilted and escapes from a critical position, resulting in no damage caused in the engaged region between the boss portions 13 and the circular bores 16. Thus, there is no provability for the vent valve 20 to be damaged owing to irregular behaviors of the fuel supply module 6 caused by possible damage of the engaged region between the boss portions 13 and the circular bores 16.

With the structure of the embodiment, specifically, since the stays 14 are located in the areas displaced away (at the right side of the center line CL) from the vent vale 20, in a case in which the fuel supply module 6 is tilted about the center of the boss portion 13, the pump 9 in the fuel supply module 6 tends to assume a position far away from the vent valve 20.

With the structure of the embodiment, further, since the vent valve 20 is mounted to the upper plate 5 in the areas at the left side of the center line CL, due to the presence of the external force F, caused by interference with the projection on the road surface, to be exerted to the bottom wall portion 3 (similarly when the bottom wall portion 3 is naturally raised due to reduced internal pressure of the fuel tank 10) of the fuel tank 1 at the position leftward of the center line CL, the bottom wall portion 3 of the fuel tank 1 remains in the inclined condition at the area away from the vent valve 20 such that, when the bottom wall portion 3 of the fuel tank 1 is brought into abutting engagement with the bottom wall 7 shaped in the inclined condition, the cornering portion of the bottom wall 7 of the fuel supply module 6 is apt to be pushed away far from the vent valve 20 than that attained in a case where the bottom wall 7 of the fuel supply module 6 is raised with the bottom wall portion 3 of the fuel tank 1 remaining in a flat condition or in an oppositely inclined condition.

FIGS. 4 to 7 shows a fuel supply module of a second embodiment according to the present invention, with like parts bearing the same reference numerals as those used in the first embodiment to omit redundant description.

With the presently filed embodiment, the vent valve 20 and the cut valve 21 are mounted to the area at the right side of the center line CL, and the feed nozzle 18 is mounted to the other area at the left side of the center line CL. Further, cylindrical stays 25, 26, that form the "guide member" of the tilting mechanism TM, are mounted to the rear surface of the upper plate 5 at left and right sides of the center line CL, respectively. These stays 25, 26 are formed with vertically elongated guide slits 27, 27, with only stay 25, formed at the left side of the center line CL, being formed at an upper end of the elongated guide slit 27 with a weakened portion 28 enabling a tilting motion of the fuel supply module 29 as will be described later in detail. The weakened portion 28 has three cutouts formed in an upper area of the slit 15 at circumferentially spaced positions of the stay 25 (see FIGS. 7A and 7B). The stay 26 mounted to the upper plate 5 at the right side of the center line CL is not formed with the weakened portion 28.

With the fuel supply module 29 of this embodiment, the case 30 has a bottom wall that is flat. And, the case 30 has shafts 32, 32, that form follower components, respectively, of the "follower member" associated with the "guide member" set forth above, standing upright from an upper portion of the case 30 at positions opposed to the stays 25, 26, respectively, to be internally inserted therein. An upper end of each shaft 32 carries a boss portion 33 which is moveable within the associated guide slit 27 of the relevant stay and also serves the "follower member". With this embodiment, thus, the boss portions 33 and the shafts 32 form the "follower member". Also, received by the stays 25, 26 are springs 34, 34 each of which serves as an "urging member" that has a lower end engaging the boss portion 33 from its upper side and an upper end held in abutting engagement with the rear surface of the upper plate 5. Accordingly, the boss portions 33 are urged downward due to, in addition to the own weight of the fuel supply module 29, the springs 34, 34 whereby the bottom wall 31 of the fuel supply module 29 is urged against the bottom wall portion 3 of the fuel tank 1.

Figure 6:
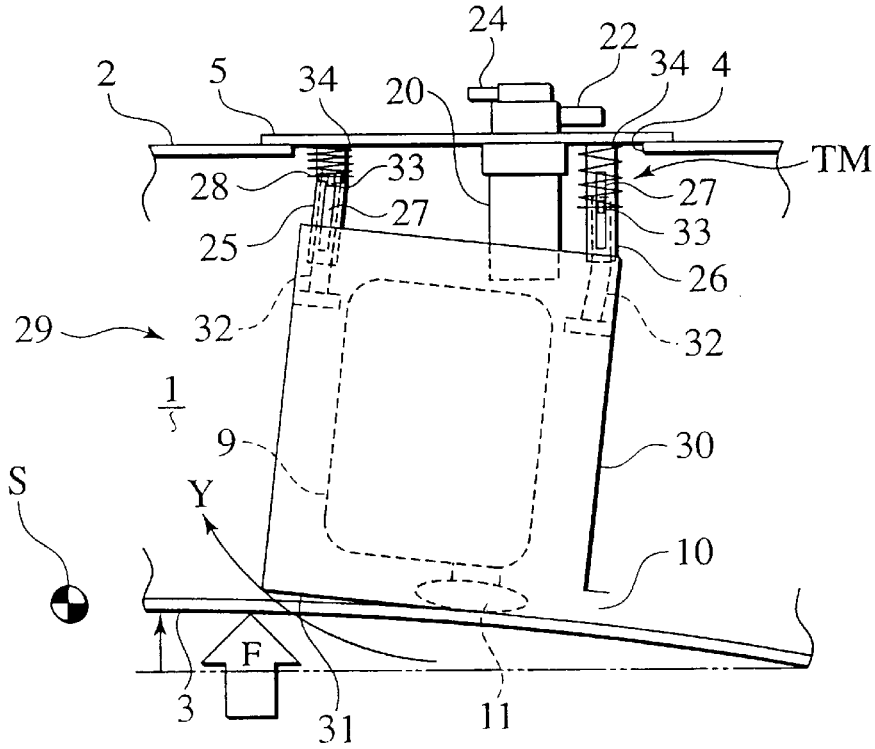
FIG. 6 is a side view illustrating the fuel supply module mounting structure, shown in FIG. 5, in its inclined condition.
Figure 7A:
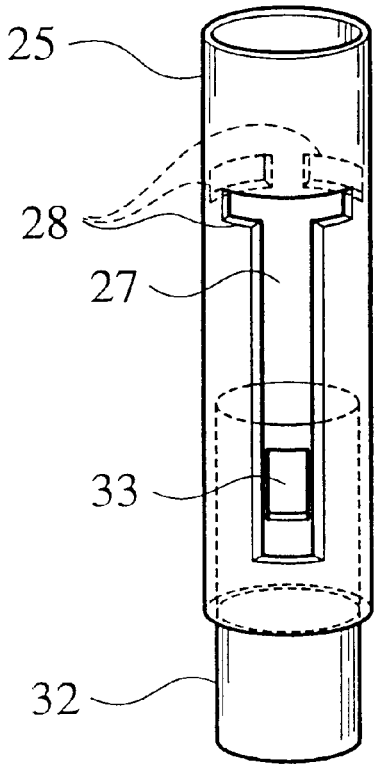
FIG. 7A is a side view of a left stay of FIG. 5.
Figure 7C:
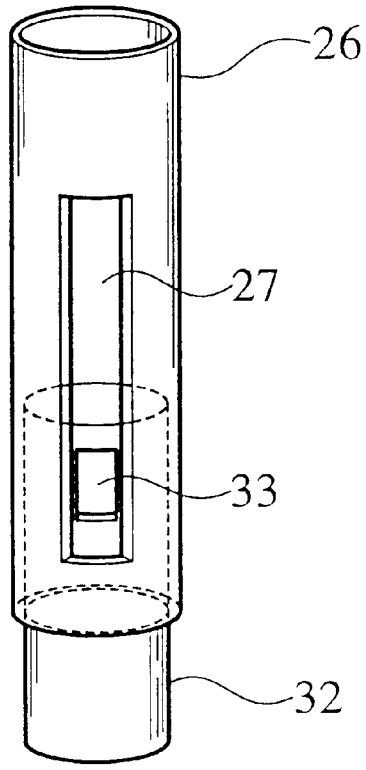
FIG. 7C is a side view of a right stay of FIG. 5
Figure 7B:
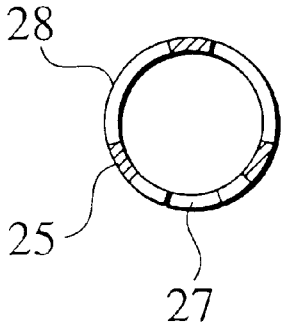
FIG. 7B is a cross sectional view of an upper end portion of a slit of the stay shown in FIG. 7A.
Figure 7D:
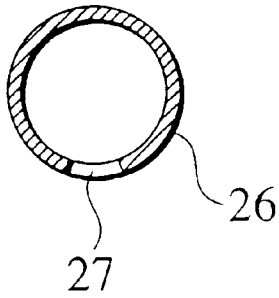
FIG. 7D is a cross sectional view of an upper end portion of a slit of the stay shown in FIG. 7C.

Now, the operation of this embodiment is described below with reference to FIG. 6. Like in the first embodiment, as the bottom wall portion 3 is raised due to the external force, in the range (with the amount d of the stroke satisfying $d<d_M$) of the given amount of stroke that causes the pump 9 to interfere with the bottom end of the vent valve 20, the boss portions 33 move along the slits 27 to allow the fuel supply module 29 to be raised while remained in the vertical attitude.

And, as the boss portions 33 reach the upper ends of the slits 27, a further upward movement of the fuel supply module 29 is avoided and the external force F is exerted to the uppermost limit position of the slit 27 via the boss portion 33. When this takes place, the weakened portions 28 of the stay 25 located at the left of the center line CL is ruptured to render the stay 26, remaining at the right of the center line CL, to remain as it is. For this reason, the entire structure of the fuel supply module is tilted in a direction (direction as shown by an arrow Y) away from the vent valve 20, avoiding interference between the vent valve 20 and the pump 9 of the fuel supply module 29.

Further, with this embodiment, since the stay 25, that is ready to be ruptured, is mounted to the upper plate 5 at the area closer to the deformation center S, the presence of the external force F, arising from interference with the projection on the road surface (like in a case wherein the bottom wall portion 3 of the fuel tank 1 is naturally raised due to the reduced internal pressure), exerted to the area of the case 30 closer to the deformation center S causes the bottom wall portion 3 of the fuel tank 1 to remain in the inclined status in which the bottom wall 31 of the case 30 at the area closer to the stay 25 to be ruptured is raised, providing an ease of causing the fuel supply module 29, whose bottom wall 31 remains in abutting engagement with the inclined bottom portion 3 of the fuel tank 1, to be reliably tilted toward (in a direction away from the vent valve 20) the stay 25 to be ruptured.

The entire content of Japanese Application No. P2001-373149 with a filing date of Dec. 6, 2001 is herein incorporated by reference.

Although the present invention has been described above by reference to certain embodiments of the invention, the invention is not limited to the embodiments described above and modifications will occur to those skilled in the art, in light of the teachings. The scope of the invention is defined with reference to the following claims.

What is claimed is:

1. A fuel supply module mounting structure for a fuel tank having an upper plate supporting a downwardly extending valve to treat evaporated fuel, the fuel supply module mounting structure comprising:

a fuel supply module having a case and a pump disposed therein to draw fuel from a fuel tank; and a tilting mechanism disposed between an upper plate of a fuel tank and the fuel supply module and including a guide member suspended from the upper plate and extending toward the fuel supply module and a follower member guided with the guide member to permit the fuel supply module to be normally moveable closer to and away from the upper plate in a freely variable stroke;

wherein the guide member and the follower member of the tilting mechanism are operative to cause the fuel supply module to be tilted in a direction to be separated away from a downwardly extending valve in response to an external force exerted to the fuel supply module during an upward movement of a bottom wall portion of the fuel tank.

2. The fuel supply module mounting structure according to claim 1, wherein the guide member includes a pair of stays extending downward from the upper plate to guide the follower member so as to permit the fuel supply module to vertically move in the freely variable stroke until the follower member reaches the uppermost limit position of the fuel supply module, and the guide member is operative to permit the follower member to tilt the fuel supply module at the uppermost limit position thereof, and wherein the fuel supply module has a bottom wall formed in an inclined surface to allow tilting movements of the fuel supply module upon abutting engagement with the bottom wall portion of the fuel tank during the upward movement thereof to permit the fuel supply module to be separated away from the downwardly extending valve.

3. The fuel supply module mounting structure according to claim 2, wherein the pair of stays are mounted to a rear surface of the upper plate at offset positions away from the downwardly extending valve.

4. The fuel supply module mounting structure according to claim 2, wherein the downwardly extending valve is mounted to the upper plate at a position closer to a deformation center of the bottom wall portion of the fuel tank.

5. The fuel supply module mounting structure according to claim 1, wherein the guide member includes a pair of stays extending downward from the upper plate and the follower member includes a pair of follower components operatively cooperating with the pair of stays, respectively, so as to permit the fuel supply module to vertically move in the freely variable stroke until the follower member reaches the uppermost limit position of the fuel supply module, and wherein one of the stays includes a weakened portion adapted to be deformed upon abutting engagement of the fuel supply module with the bottom wall portion of the fuel tank during the upward movement thereof to permit the follower member to tilt the fuel supply module at the uppermost limit position thereof to permit the fuel supply module to be separated away from the downwardly extending valve.

6. The fuel supply module mounting structure according to claim 5, further comprising an urging member urging at least one of the follower components downward.

7. The fuel supply module mounting structure according to claim 5, wherein one of the pair of stays are mounted to the upper plate at a position closer to a deformation center of the bottom wall portion of the fuel tank.

8. A fuel supply module mounting structure for a fuel tank having an upper plate supporting a downwardly extending valve to treat evaporated fuel, the fuel supply module mounting structure comprising:

a fuel supply module having a case and a pump disposed therein to draw fuel from a fuel tank; and a tilting mechanism disposed between an upper plate of a fuel tank and the fuel supply module and including guide means suspended from the upper plate and extending toward the fuel supply module and follower means guided with the guide means to permit the fuel supply module to be normally moveable closer to and away from the upper plate in a freely variable stroke;

wherein the guide means and the follower means are operative to cause the fuel supply module to be tilted in a direction to be separated away from a downwardly extending valve in response to an external force exerted to the fuel supply module during an upward movement of a bottom wall portion of the fuel tank.

* * * * *